United States Patent [19]

Gryglas

[11] 4,092,941

[45] June 6, 1978

[54] ADJUSTABLE TWO-WAY CAM CLEAT

[76] Inventor: Stephen Gryglas, 1874 Fenton La., Park Ridge, Ill. 60068

[21] Appl. No.: 779,308

[22] Filed: Mar. 21, 1977

[51] Int. Cl.[2] ..... B63B 21/08

[52] U.S. Cl. ..... 114/218; 24/134 R

[58] Field of Search ..... 114/218, 199; 24/134 R, 24/134 L, 134 KA, 134 KB, 134 N, 134 P; 188/65.1-65.5; 254/76; 269/257

[56] References Cited

U.S. PATENT DOCUMENTS

| | | | |
|---|---|---|---|
| 525,624 | 9/1894 | Sabroe | 114/218 |
| 1,058,577 | 4/1913 | Gardner | 24/134 R |

FOREIGN PATENT DOCUMENTS

| | | | |
|---|---|---|---|
| 1,212,244 | 11/1970 | United Kingdom | 24/134 P |

*Primary Examiner*—Trygve M. Blix
*Assistant Examiner*—Stuart M. Goldstein
*Attorney, Agent, or Firm*—Robert E. Wagner; Thomas L. Kautz

[57] ABSTRACT

A two-way adjustable cam cleat is provided for use such as on sailboats having a fixed cam jaw rotatably mounted to a base opposite a movable cam jaw which is adapted with the base to vary the nip between the cams. Mounted on the arcuate periphery of each cam is a unique configuration of jaw teeth which enables the cams to engage with a line disposed therebetween to prevent movement in opposing axial directions.

6 Claims, 8 Drawing Figures

FIG. 1
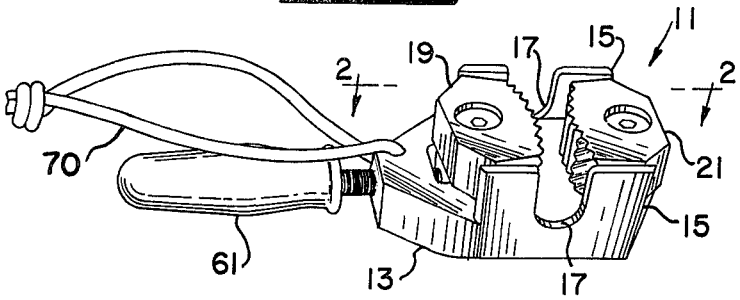
FIG. 5
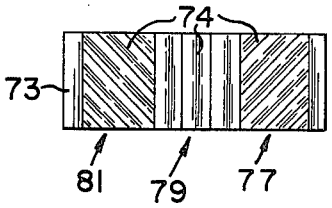
FIG. 2
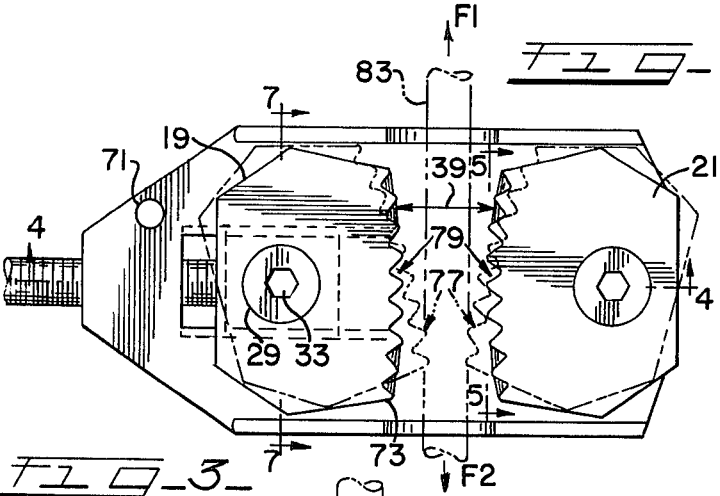
FIG. 7
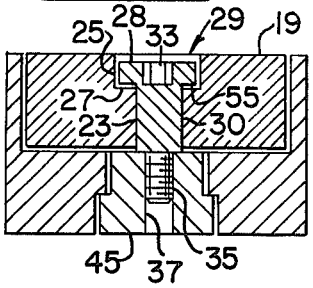
FIG. 3
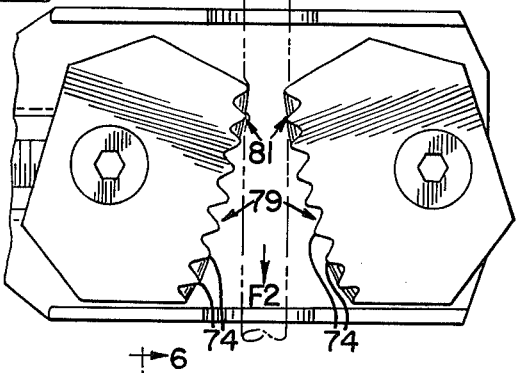
FIG. 6
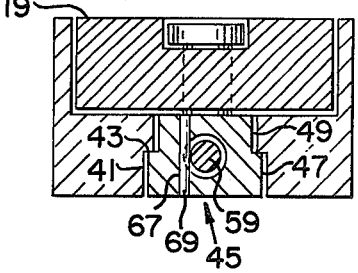
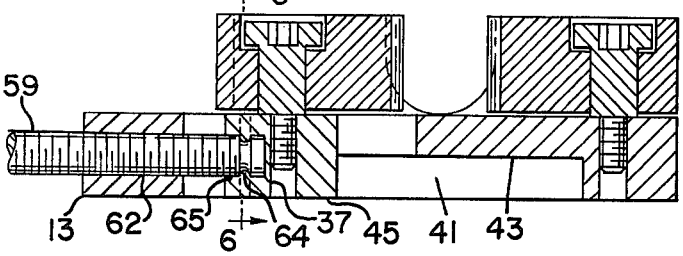
FIG. 4
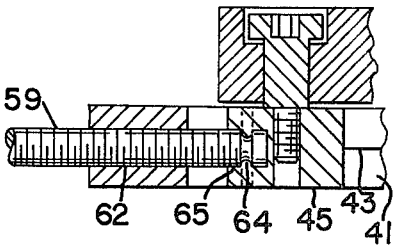
FIG. 8

ADJUSTABLE TWO-WAY CAM CLEAT

FIELD OF THE INVENTION

This invention relates generally to devices used to secure ropes and lines, and more particularly, to an adjustable two directional cam cleat for releasably holding all sizes of sheets and halyards and other running rigging used on sailboats.

BACKGROUND OF THE INVENTION

Cam cleats of the type typically used in sailboats, consist generally of a pair of spring-biased cam-like jaws having a plurality of teeth mounted on their arcuate surface. The cams are pivotally mounted opposite one another, to a flat base structure. A line to be held by the cleat is inserted between the arcuate surfaces of the cams and pulled in a direction opposite to the axial force on the line. The cams are rotated against the bias of the spring as the line is pulled between them, forming a nip or line receiving space. When the line is released, it is jammed between the cams as the teeth engage the line and secure it against movement in the direction of the axial tension. If required, the frictional hold developed by the cams may be increased by sharpening the teeth along the arcuate surface.

Certain prior art cam cleats intended for use with sailboats and the like are designed to receive and hold a line in one direction only. Once mounted on the gunnel of the sailboat or elsewhere, these existing cam cleats are limited in use to the direction in which they face.

Another problem associated with prior art cleats is that the cam jaws are mounted in a fixed relation to one another on the base. Thus, the nip is dependent on the degree of curvature of the arcuate surfaces of the cams. If the degree of curvature on the arcuate surfaces is relatively acute, the cams may be rotated to accomodate lines from small to larger diameters, but the frictional holding capability of the cleat is sacrificed since fewer jaw teeth engage the line to be clamped than would be provided by a cam jaw having a slight curvature of the arcuate surface. Conversely, if cam jaws having arcuate surfaces with slight curvatures are employed to improve the holding capability of the cleat, the line receiving space between the cam is limited and only a small range of rope diameters may be accomodated.

The use of nylon and other synthetically made materials has permitted the manufacture of high strength lines of such smaller diameter than equivalent strength hemp ropes. As a result, those prior art cleats designed to accomodate the larger diameter hemp rope lines may permit slippage with the use of smaller nylon lines under normal tensile loading. In addition, it is difficult to force larger lines between the cam jaws of conventional cam cleats. This is especially apparent where the clamping operation must be quickly accomplished such as to avoid capsizing or during sailboat racing.

SUMMARY OF THE INVENTION

In view of the deficiencies associated with existing cleats, the present invention provides a two-directional adjustable cam cleat which is portable and also adaptable for mounting on a sailboat. The cam cleat consists of a fixed cam jaw rotatably mounted to a base by a pin, opposite an adjustable cam. The adjustable cam is rotatably mounted upon a traveling member which is disposed within a machined opening in the base. An adjustment means causes the traveling member to move along the length of said opening, and since the adjustable cam is attached thereto it moves with the traveling member. Thus, the nip or line receiving space between the two cams is readily varied. Regardless of the diameter of the line to be clamped, the line receiving space may be quickly adjusted to accommodate the line. In addition, the adjustment capability of the present invention allows the curvature of the arcuate surfaces of the cams to be slight enabling a maximum number of teeth to engage a line to be clamped. Since the cam cleat is portable and adjustable, it may be moved to any part of the sailboat and is adjustable to clamp any size rigging encountered.

Both cams have an arcuate surface with a plurality of teeth disposed in a unique arrangement thereon. The tooth arrangement forms three sections along the arcuate surface, with the teeth at one end of the fixed cam forming a mirror image of those at the opposite end. Both end sections of teeth are disposed at an acute angle from a middle section of teeth which extend normally from the arcuate surface. The tooth arrangement of the adjustable cam is the mirror image of that of the fixed cam. Accordingly, a line placed between the arcuate surfaces of the two cams will be engaged by the teeth at one end of the cams against an axial force in one direction, and the teeth at the opposite end of the cams will secure a line tensioned in the opposite axial direction.

Therefore, in consideration of the deficiencies of existing cleats, it is an object of the present invention to provide a cam cleat having an adjutable cam for varying the line receiving space between it and a fixed cam, to accommodate lines of all diameters.

Another object of this invention is to provide a cam jaw having a tooth arrangement where teeth at one end of the arcuate surface of the cam are the mirror image of those at the opposite end, thus permitting lines tensioned in opposite directions to be secured without changing the position of the cam cleat.

A further object of this invention is to provide a portable cam cleat for use anywhere on a sailboat which is also adaptable for permanent mounting, if desired.

The particular nature of this invention, as well as additional objects and advantages thereof, will become apparent upon reference to the attached drawings and detailed description of the preferred embodiments of the invention, wherein:

DESCRIPTION OF THE DRAWINGS

FIG. 1 is an overall perspective view of the present invention;

FIG. 2 is a plan view showing the cam jaws rotated in a position to hold the line clamped therebetween from movement in the direction of the axial force F1;

FIG. 3 is a plan view showing the cam jaws rotated in a position to hold the line clamped therebetween from movement in the direction of the axial force F2;

FIG. 4 is a cross sectional view in full elevation taken along the line 4—4 of FIG. 2;

FIG. 5 is a front view of the arcuate surface of a cam jaw showing the unique tooth arrangement of the present invention;

FIG. 6 is a front sectional view taken along the line 6—6 of FIG. 4;

FIG. 7 is a front sectional view taken along line 7—7 of FIG. 2; and, FIG. 8 is a partial cross sectional view of another embodiment of the present invention taken along section line 4—4 of FIG. 2 as in FIG. 4.

DETAILED DESCRIPTION OF THE INVENTION

Referring to FIG. 1, an overall perspective view of the adjustable two-directional cam cleat 11 is shown. An elongated flat base structure 13 is provided, having vertical sidewalls 15 which extend part way along the length of the base 13. The sidewalls 15 are formed with a U-shaped cutout section 17 near their centers, providing a guide for properly positioning a rope to be clamped.

Pivotally mounted on the base 13 are a movable cam jaw 19 and a fixed cam jaw 21. The structure and mounting means of the two cams are identical, except that they are mirror images of each other. Therefore, only the structure of the movable cam jaw 19 will be discussed in detail, with all the reference numerals used in that description applied to the fixed cam jaw 21 as well.

As best viewed in FIG. 7, a lower bore 23 is cut through the cam jaw 19 and an upper bore 25 of a slightly larger diameter is cut part way down from the top of the cam jaw 19 concentric to bore 23. Thus, a shoulder 27 is formed at the point where the upper bore 25 stops and the lower concentric bore 23 continues.

A pin 29 is provided to mount cam jaw 19 to a movable block 45, which block 45 is discussed in detail below in connection with the adjustment means of the present invention. The pin 29 is formed in a T-shape corresponding to the diameters of the concentric bores 23 and 25. The head section 28 of the pin 29 has a diameter slightly less than that of the upper bore 25, and the stem section 30 of the pin 29 has a diameter slightly less than that of the lower bore 23, thus permitting the cam jaw 19 to freely rotate about the pin 29. Extending from the base of the stem section 30 of the pin 29 is a threaded nipple 35. A hexagonal section 33 is machined a short depth into the head section 28 of the pin 29.

A bore 37, correspondingly threaded with the nipple 35 is formed in the movable block 45. The cam jaw 19 is mounted to the movable block 45 by inserting the pin 29 into the cam jaw 19, causing the nipple 35 to engage with the threaded bore 37. The pin 29 is tightened to the movable block 45 by inserting an allen wrench or a similar hex-shaped wrench into the machined hex section 33 in the head section 28 of the pin 29, and then turning the nipple 35 into the bore 37. Cam jaw 21 is identically mounted, except that it is mounted to the base 13.

As discussed previously, an important feature of the present invention is the provision of an adjustable cam jaw 19 which varies the width of the line receiving space or nip 39 between the two cam jaws 19 and 21 (FIG. 2). Certain prior art sheet stops were developed to accommodate relatively thick lines made primarily of hemp. The development of strong synthetic materials such as nylon, however, has enabled manufactures to make lines of much less diameter than hemp ropes without sacrificing strength. Use of smaller nylon lines in place of hemp in certain prior art structures has resulted in line slippage under normal tensile loading.

Accordingly, the present invention includes a means of adjusting the nip 39 to easily accommodate lines of widely varying diameters with minimum slippage. Referring now to FIG. 6, a rectangular opening 41 formed with a shoulder 43 is machined in the base 13. A movable block 45 formed in the shape of a T, having a head section 47 and a stem section 49, is disposed within the opening 41 in the base 13. The dimensions of the head 47 and stem 49 sections of the movable block 45 are slightly less than the corresponding dimensions of the shouldered opening 41 in the base 13, allowing the adjustment rod 59, discussed in detail below, to slide the movable block 45 along the shoulder 43 of the opening 41.

The block 45 is moved back and forth along the shoulder 43 of the opening 41 in the base 13 by means of a threaded stainless steel adjustment rod 59. The adjustment rod 59 is attached at one end to the handle 61 (see FIG. 1) and near the other end a groove 64 is formed around the diameter of the adjustment rod 59. As viewed in FIGS. 4 and 8, a bore 62, correspondingly threaded with the adjustment rod 59, is formed in the base 13 and extends into the opening 41. A second bore 65, formed to receive the adjustment rod 59, is cut into block 45 to a point just short of the threaded bore 37. As seen in FIG. 6, a drilled hole 67 is cut into the block 45, corresponding to the slot 64 formed in the rod 59.

Adjustment of the cam jaw 19 proceeds as follows. The rod 59 is threaded into the base 13 to the opening 41 through the correspondingly threaded bore 62. The rod 59 is inserted into the block 45 through bore 65, and held thereto by aligning the drilled hole 67 in the block 45 with the slot 64 in the rod 59, and then inserting a roll pin 69 into the slot 64 and hole 67. The roll pin 69 allows the rod 59 to rotate within the block 45, but the rod 59 is held from moving laterally with respect to the block 45. Thus, as the rod 59 is rotated in and out of the base 13, the block 45 is correspondingly moved back and forth along the shoulder 43 in the opening 41. Since the cam jaw 19 is mounted to the movable block 45 by pin 29, it also moves. Therefore the nip 39 or line receiving space between the two cams 19 and 21, is adjusted by rotating the rod 59 in or out of the base 13.

The forces exerted on the cam jaws 19 and 21 by lines clamped therebetween have vertical and horizontal components which tend to lift the cam jaws 19 and 21 from the base 13 and at the same time to force the movable cam jaw 19 to travel along the opening 41 in the base 13.

Referring to FIG. 7, the lower surface of the head section 28 of the pin 29 overlaps the shoulder 27 formed in cam jaws 19 and 21. As the cam jaws 19 and 21 begin to move upward in response to the vertical force exerted by a line clamped therebetween the shoulder 27 of the cam jaws 19 and 21 is forced against the overlapping bottom portion of the head section 28 of pin 29 preventing further upward movement. Lateral movement of the movable cam jaw 19 in response to the horizontal force exerted by a line is prevented as the bore 62 as shown in FIGS. 4 and 8 is finely threaded with the rod 59 to hold the block 45, attached to the movable cam jaw 19, firmly in place.

Certain prior art sheet stops are designed to clamp lines against movement in one direction only. The cam jaws used in these prior art structures are formed with teeth disposed in substantially one direction. Since these sheet stops are intended to be permanently affixed to the gunnels of the sailboat, they are useless for holding lines tensioned in the direction opposite to the direction they face. In addition, certain prior art sheet stops are constructed with cam jaw teeth so sharp that lines may be partially severed and severely weakened by repeated clamping within a short period of use under normal tensile loading.

Accordingly, the present invention provides a portable cam cleat 11 equipped with a lanyard 70 threaded through hole 71 in the base 13 (see FIG. 2), for convenient carrying wherever the cam cleat 11 is needed. In another embodiment, bores (not shown) may be made in the base 13 to permanently mount the sheet stop 11 to the gunnels of the sailboat if desired.

In addition to being portable, the cam cleat 11 employs a unique tooth arrangement on the arcuate surface 73 of the cam jaw 19 which enables lines tensioned in opposite directions to be firmly held without altering the direction in which the cam cleat 11 faces. As best seen in FIG. 5, the arcuate surface 73 is comprised of three sections of jaw teeth 74. The teeth 74 in the section indicated by 77 are disposed at an acute angle of approximately 45 degrees from the middle section of teeth 74, indicated by 79, which extend normally from the arcuate surface 73. The section of teeth 74, indicated by 81, also extend at an acute angle from the middle section 79 of teeth 74 except that the teeth in section 81 are the mirror image of those in section 77.

Referring now to FIGS. 2 and 3, the two-directional holding capability of the present invention is illustrated. Assuming an axial force F1 is exerted on the line 83, cam jaws 19 and 21 will rotate to the position shown wherein the teeth 74 in section 77 at the bottom of the arcuate surface 73 as viewed in FIG. 2, will engage the line 83 and hold it firmly in place against the force F1. Reversing the direction of the axial force on the line 83 as represented by F2, will cause cam jaws 19 and 21 to rotate to a position wherein the section 81 of teeth 74 shown at the top of the arcuate surface 73 in FIG. 3, will similarly firmly engage with the line 83 and hold it in place against movement in the direction of axial force F2. A line 83 jammed into the nip 39, or line receiving space between the cam jaws 19 and 21, will thus be firmly held regardless of the direction in which the line 83 is tensioned.

The teeth 74 in sections 77 and 91 are disposed at an acute angle from the teeth 74 in the middle section 79 to improve the frictional grip on the line 83. As the line 83 is engaged between cam jaws 19 and 21, the angular orientation of the teeth 74 tends to force the line 83 against the base 13. The line 83 is not only jammed between the teeth 74 of cam jaws 19 and 21 to hold it against movement, but it is also cammed downward against the base 13. As a result, the leading edge of the jaw teeth 74 which engages the line 83 need not be as sharp as those teeth used in certain prior art cam cleats wherein the teeth alone are relied on to grip the lines. Wear and tear on the lines, accelerated by repeated clamping between the sharp teeth of prior art cam cleats is thus reduced by the present invention.

The teeth 74 in the middle section 79 of the cam jaw 19 aid in holding the line 83 from slipping as it is placed into the nip 39 for clamping. For a line 83 to be clamped by the present invention it is first inserted into the nip 39, the nip 39 is then adjusted as discussed above, and finally cam jaws 19 and 21 rotate to engage the line 83 preventing movement in either of two opposing axial directions. Although the adjustment and clamping procedure may be rapidly accomplished, the middle section 79 of the teeth 74 is useful for holding the line 83 in its position between cam jaws 19 and 21 prior to clamping. This feature of the present invention is particularly valuable on occasions such as single handling of a sailboat or during a race where lines must be secured as quickly and efficiently as possible.

While the invention has been particularly shown and described with reference to preferred embodiments thereof, it will be understood by those skilled in the art that various changes in form and details may be made therein without departing from the spirit and scope of the invention.

I claim:

1. An adjustable cam cleat particularly adapted for releasably holding lines of different diameters against axial tension exerted on said lines in opposite axial directions, comprising:

a base;

a first cam jaw having an arcuate periphery with first engaging means mounted thereon for engaging a line, said first cam jaw being pivotally mounted on said base about a first axis normal to said base;

adjustment means movably mounted on said base;

a second cam jaw having an arcuate periphery with second engaging means mounted thereon for engaging said line, said second cam jaw being pivotally mounted on said adjustment means about a second axis normal to said adjustment means, said second cam jaw being disposed a distance opposite said first axis, said second cam jaw being movable with said adjustment means linearly relative to said first axis to vary said distance therebetween for accommodating lines of different diameters between said first and second cam jaws, whereby said first and second engaging means engage said line disposed between said first and second cam jaws and cooperate to hold said line from movement in opposite axial directions.

2. The cam cleat of claim 1 wherein said base is an elongated flat section formed with a rectangular opening having a shoulder extending the length of said opening;

said means of adjustment includes a threaded adjustment rod and a movable member;

said second cam jaw is rotatably mounted on said movable member;

said opening in said base is adapted to receive said movable member, the dimensions of said movable member being slightly less than the corresponding dimensions of said opening, said movable member being formed with a bearing surface adopted to contact said shoulder in said opening;

said adjustment rod is adapted with said base to move in and out of said base as said adjustment rod is rotated; and, said adjustment rod is adapted with said movable member to cause said movable member to travel along said shoulder of said opening in cooperation with said adjustment rod as said adjustment rod is rotated in and out of said base, whereby said second cam jaw mounted on said movable member is likewise caused to travel along the length of said opening as said adjustment rod is rotated thus varying the nip between said second cam jaw and said first cam jaw.

3. The cam cleat of claim 2 wherein a bore is formed in said base to receive said adjustment rod, said bore being correspondingly threaded with said adjustment rod, whereby said adjustment rod in cooperation with said threaded bore may be rotated in and out of said base.

4. The cam cleat of claim 2 wherein said adjustment rod is formed with a machined slot extending around its diameter at one end; a bore is formed in said movable member to receive said adjustment rod, and a machined slot is formed in said movable member in alignment with said slot in said adjustment rod, whereby a roll pin may be inserted into said aligned slots for attaching said adjustment rod to said movable member to prevent lateral movement of said rod with respect to said member but to allow for rotation of said rod within said member.

5. A pair of cam jaws each having an arcuate periphery adapted for use with a cam cleat for releasably holding lines, said cam jaws having a configuration of jaw teeth mounted on said arcuate periphery, said configuration comprising a middle section of teeth between two end sections of teeth, said teeth in said middle section extending normally from said arcuate surface, said teeth in said end sections extending at an acute angle from said teeth in said middle section, said end sections being mirror images of one another, said configuration of jaw teeth mounted to said arcuate periphery of one cam jaw being the mirror image of those jaw teeth mounted on the arcuate periphery of the other cam jaw whereby said cam jaws cooperate to permit corresponding end sections of teeth to engage lines disposed therebetween for securely holding said lines from movement in either of two opposing axial directions.

6. The cam cleat of claim 1 wherein said first engaging means comprises jaw teeth mounted on the arcuate periphery of said first cam jaw in a first configuration having two end sections and a middle section of jaw teeth, said jaw teeth in said end sections being disposed at an acute angle from said base with one end section being the mirror image of the other, said jaw teeth in the middle section being disposed normally from said base; said second engaging means comprises jaw teeth mounted on the arcuate periphery of said second cam jaw in a second configuration which is the mirror image of said first configuration whereby said cam jaws cooperate to permit corresponding end sections of said first and second engaging means to engage a line disposed therebetween for securely holding said line in opposite axial directions.

* * * * *